United States Patent [19]

Salomon

[11] 4,104,766

[45] Aug. 8, 1978

[54] CLOSING SYSTEM FOR SKI BOOTS

[75] Inventor: Georges Pierre Joseph Salomon, Annecy, France

[73] Assignee: S.A. des Etablissements Francois Salomon & Fils, Annecy, France

[21] Appl. No.: 780,180

[22] Filed: Mar. 22, 1977

[30] Foreign Application Priority Data

Mar. 29, 1976 [FR] France ..... 76 09009

[51] Int. Cl.[2] ..... B27K 3/04

[52] U.S. Cl. ..... 24/69 SK; 36/50

[58] Field of Search ..... 36/50; 24/68 SK, 68 E, 24/69 SK, 70 SK, 71 SK

[56] References Cited

U.S. PATENT DOCUMENTS

| | | | |
|---|---|---|---|
| 3,333,302 | 8/1967 | Klima | 24/70 SK |
| 3,399,430 | 9/1968 | March | 24/70 SK |
| 3,521,330 | 7/1970 | Steinberg | 24/70 SK |

FOREIGN PATENT DOCUMENTS

| | | | |
|---|---|---|---|
| 1,465,663 | 12/1966 | France | 24/70 SK |
| 413,659 | 12/1966 | Switzerland. | |

*Primary Examiner*—Doris L. Troutman

*Attorney, Agent, or Firm*—Haseltine, Lake & Waters

[57] ABSTRACT

The present invention involves a ski boot closure system for ski boots equipped with a quick-closing lever and associated rack system.

This knuckle joint-type closing system for ski boots, brings the first and second boot flaps together, it includes at least one lever hinged to the first boot-flap and a traction component hinged to the second boot flap and to the lever, one of the lever's hinges being formed by a catch-pin freely engaged in a notch, the lever being capable of occupying an initial, closed position flap against the boot, a second, stable intermediate or partially-open position, and a third, fully-open position in which the catch-pin is disengaged from the notch. This system further comprises a mechanism for making the catch-pin automatically leave the notch when the opening lever movement is continued beyond the stable intermediate position, thereby separating the two boot-flaps.

14 Claims, 19 Drawing Figures

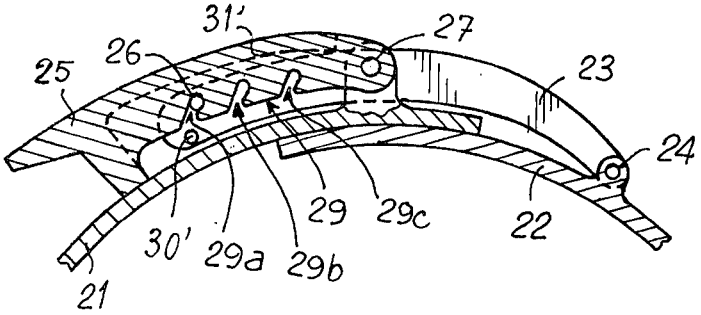
FIG.6
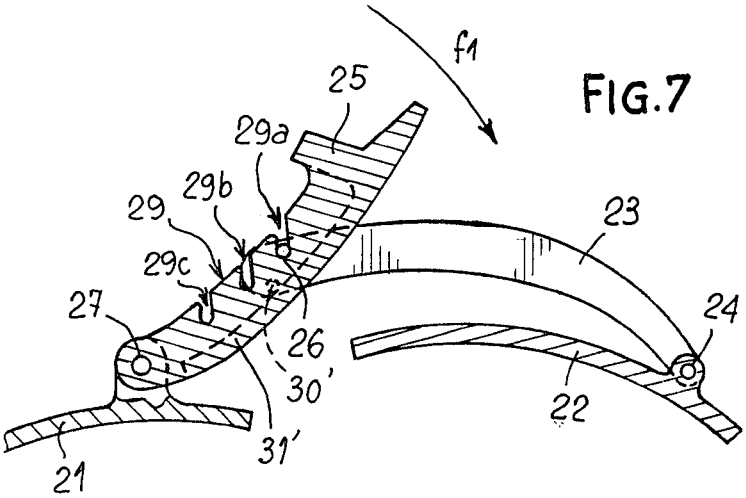
FIG.7
FIG.8
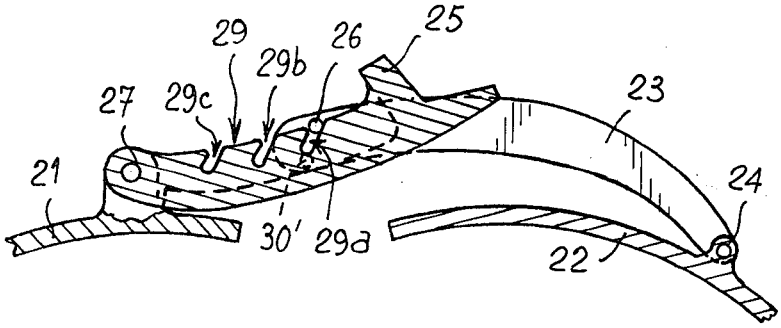

FIG.9
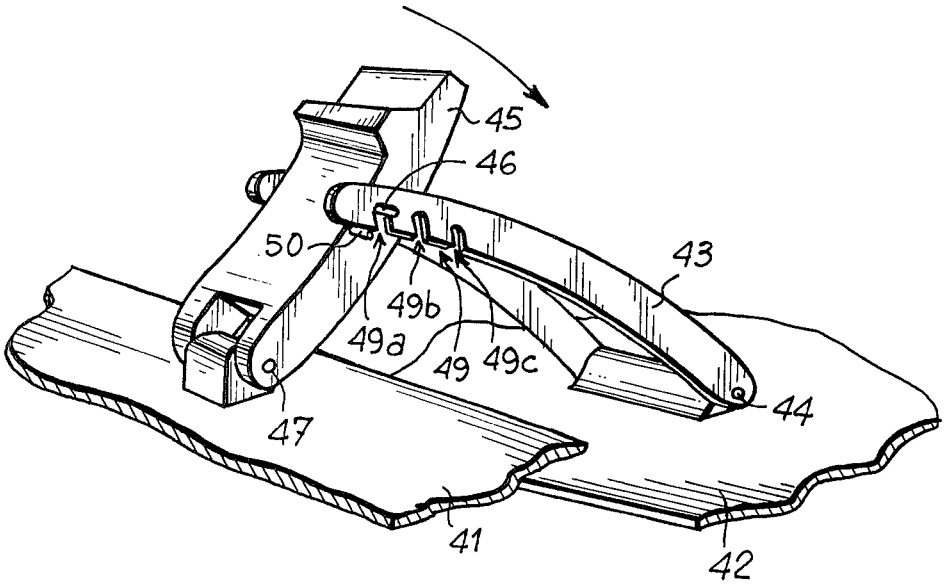
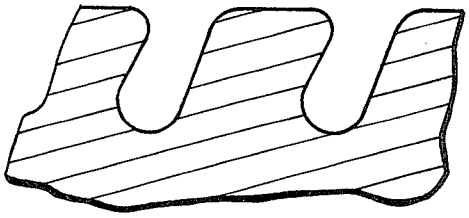
FIG.13
FIG.14
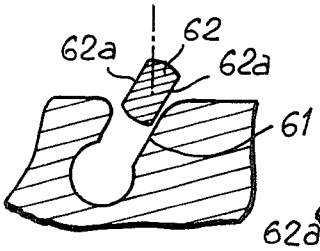
FIG.15
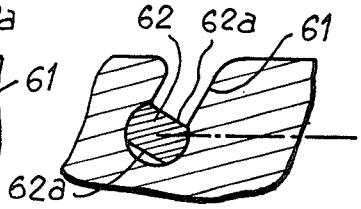
FIG.16
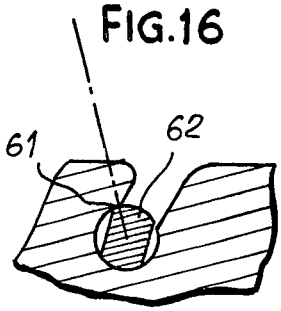

CLOSING SYSTEM FOR SKI BOOTS

BACKGROUND OF THE INVENTION

The present invention relates to a ski boot closure system.

Ski boots equipped with quick-closing lever and associated rack systems are already known. They have been successively used for front-opening ski boots and rear-opening ski boots. In all cases, these systems involve the bringing together of two parts of the boot. Generally speaking, these quick fasteners include a number of notches and/or a screw-and-nut adjusting system permitting adjustment of the tension exerted between the two flaps of the ski boot. During actual skiing, this tension is often great; when not skiing, the skier frequently wishes to loosen the buckles in order to walk or to stand normally in the lift waiting line. To this end, the quick fastener or buckle must be equipped with a system allowing the boot to be slightly loosened, but holding the foot sufficiently in the boot to prevent it from accidentally slipping out, or too great of a relative foot movement inside the boot while walking. This walking position should be stable, i.e., the buckle should not be able to accidentally open or close.

It is also necessary that the buckle be equipped with a system permitting the buckle adjustment to be maintained, to avoid the need for readjustment of buckle tension. A number of solutions to this problem have already been proposed. These solutions fall into two catagories, depending on whether the buckle parts, respectively fastened to each of the boot flaps, offer — or do not offer — the possibility of separating the buckle from the flaps, or the buckle parts from one another.

The solutions of the first category do not permit total boot opening. This is a serious disadvantage, particularly in the case of rear-opening boots, which require an ample rotation of the rear part of the boot.

The solutions within the second category permit full buckle opening, but this requires that the boot-flaps be manually closed again, at least slightly. Buckle opening thus requires the use of both hands.

Moreover, there is a danger of the two buckle parts opening accidentally, particularly while walking, when the buckle is not under tension, thereby eliminating any pressure holding the foot in the boot.

SUMMARY OF THE INVENTION

An object of the present invention is to eliminate these two disadvantages. It consists in a buckle offering a loosened position, preventing any accidental opening, and being equipped with a device permitting complete buckle opening without the need for again closing the boot flaps by manual means.

Pursuant to the invention, this toggle-joint closing system for ski boots, bringing together two boot flaps, having at least one lever hinged to the first boot flap, and a traction component hinged (a) to the second boot flap and (b) to the lever, one of the lever's articulations being formed by a catch-pin freely engaged in a notch, the lever being capable of occupying an initial closed position flap against the boot, a second, stable "walking" intermediate or partially-opened position, and a third, fully-open position in which the catch-pin is disengaged from the notch, is characterized by the provision of means to make the catch-pin automatically leave its notch when the opening motion of the lever is continued beyond the stable intermediate position, thereby separating the two ski boot flaps.

BRIEF DESCRIPTION OF THE DRAWINGS

The invention shall be described at greater length in the following, with preference to the appended figures.

FIGS. 6, 7 and 8 are cross-section views of the system of FIG. 5, in the closed and intermediate "walking" positions and immediately prior to the fully-open position, respectively.

FIG. 9 is a perspective view of a third embodiment of the invention, in the "walking" position.

FIG. 13 is a large-scale cross-section of a portion of the adjusting rack, for any of the above embodiments.

FIGS. 14, 15 and 16 are cross-sections showing the operation of a notch for one variant of the three embodiments.

DESCRIPTION OF THE PREFERRED EMBODIMENTS

Figure 3A:
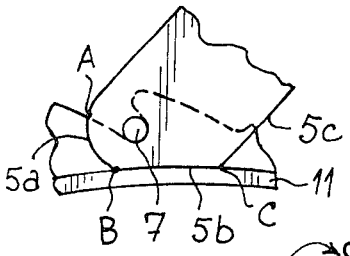
Figure 3:
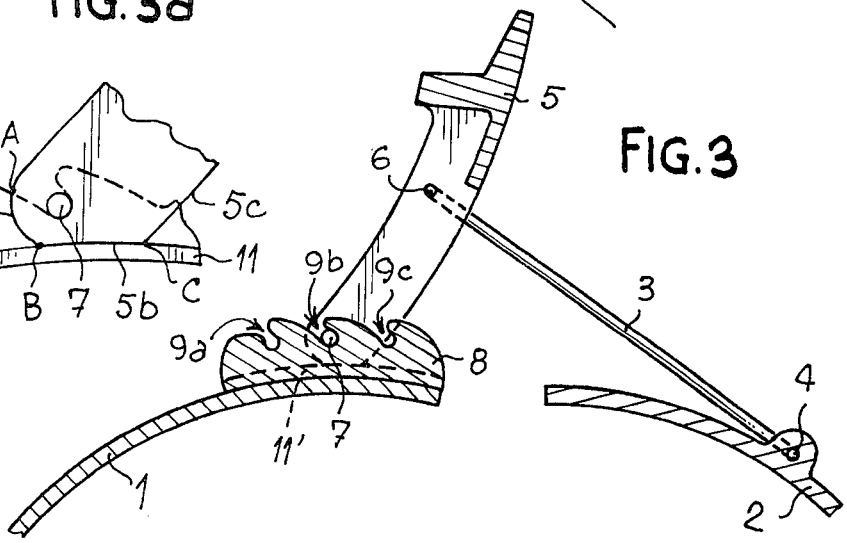
Figure 4A:
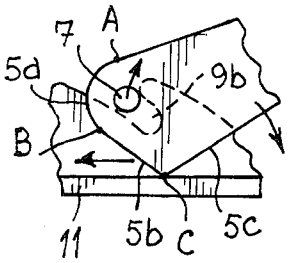
Figure 4:
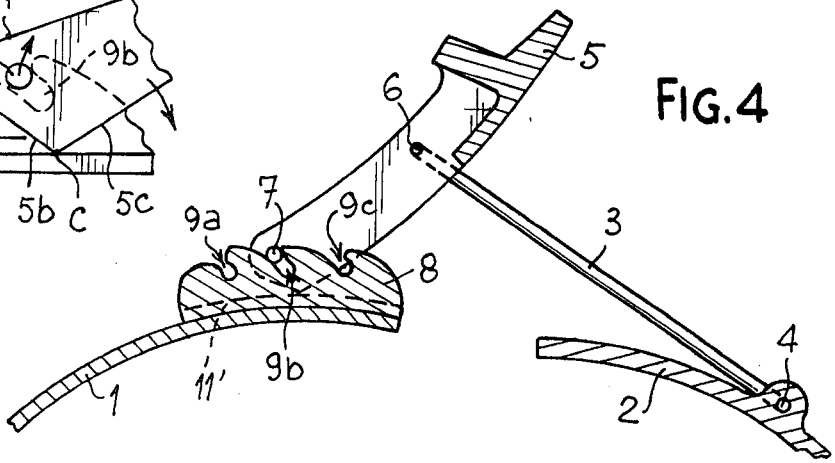
Figure 10:
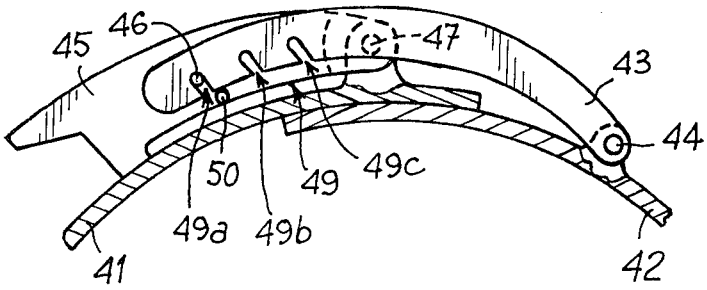
FIGS. 10, 11 and 12 are cross-section views of the system of FIG. 9 in closed and intermediate "walking" positions and immediately prior to the fully-open position, respectively.
Figure 11:
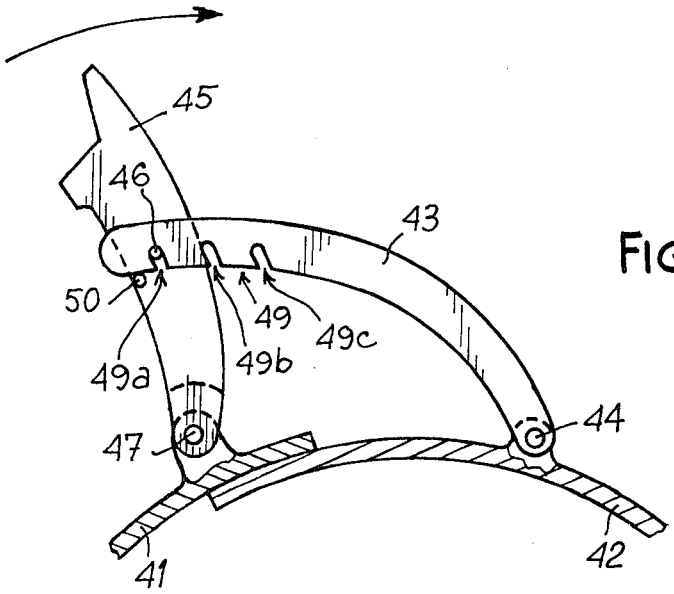
Figure 12:
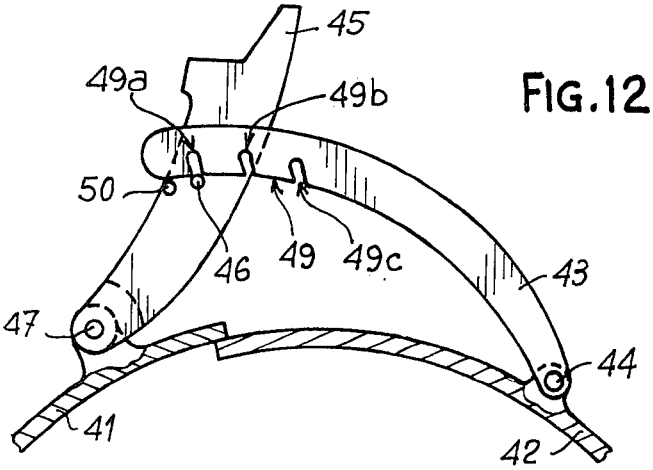

FIGS. 1, 2, 3 and 4 represent an initial version of the invention. The buckle is shown in its closed position (FIG. 2), walking position (FIGS. 1 and 3) and opened (FIG. 4).

The two boot flaps are shown at 1 and 2. The closing system described is of the toggle-joint lever type. It includes a stirrup-shaped lever 5, and a traction component 3 made of a flexible material (e.g., loop formed by a cable), one end of which is fastened to flap 2 by means of a pin 4. Its other end is fastened to lever 5 by means of a pin 6 (located in the central portion of lever 5). Lever 5 has a catch pin 7 at one end, extending between the two parallel branches of the lever. The catch-pin 7 makes it possible to engage lever 5 in a rack 8 presenting a number of notches 9*a*, 9*b* and 9*c*, pin 7 engaging in one of these notches, depending upon the desired tension adjustment when the boot is closed. Rack 8 is extended and fastened to flap 1 by standard methods (riveting, welding, clipping, etc.), or is moulded integrally with flap 1.

By pivoting lever 5 in the direction of arrow *f* (counter-clockwise) starting from the "walking" position (FIGS. 1 and 3), flaps 1 and 2 are brought together and the boot is closed, due to the fact that pins 6 and 7 (and consequently flaps 1 and 2) are shifted toward one another. In this position, lever 5 is folded down flat against flap 1 and rack 8.

As loop 3 passes between flaps 1 and 2 and pin 7, the closed position of lever 5 is stable. The notches of rack 8 are substantially oriented in a direction opposite to the direction in which traction is exerted on pin 7 in the closed position, and the dimension of the opening of these notches is smaller than the diameter of pin 7, so that this pin cannot accidentally escape from notch 9*a*, 9*b* or 9*c* in which it is lodged. The edges of the opening of each notch are preferably rounded in order to facilitate catch-pin insertion (see FIG. 13).

In the area of pin 7, both branches of lever 5 have a profile with a portion of a circular arc 5*a* centered on pin 7 and forming an arc AB, then a flat surface 5*b* between points B and C followed by a slightly-curved edge 5*c* forming, with 5*b*, an obtuse angle with C at the apex. This section is situated opposite a lateral flange 11 of rack 8, and the radius of arc AB is substantially equal to the distance between the center of pin 7 and flange 11 when this pin is bottomed in notch 9*a*, 9*b* or 9*c*. Moreover, apex C is situated at a distance from the center of pin 7 greater than the distance between this center and the flange 11, when pin 7 is bottomed in the notch.

Figure 1:
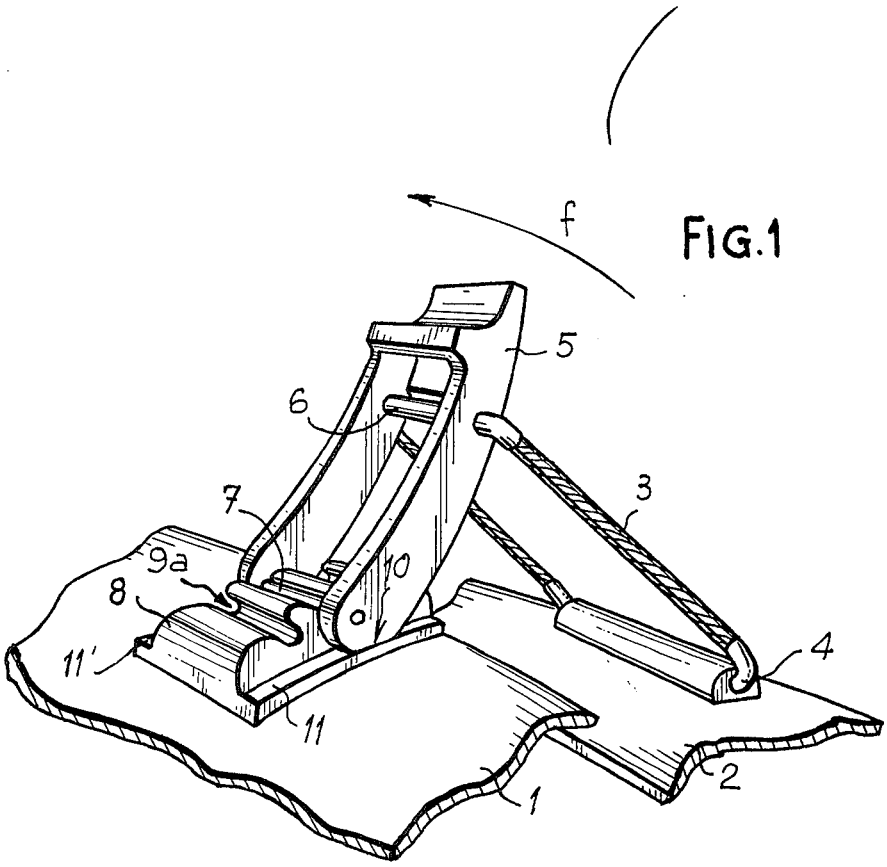
FIG. 1 is a perspective view of a first embodiment of a closing system pursuant to the invention, in the "walking" position.
Figure 5:
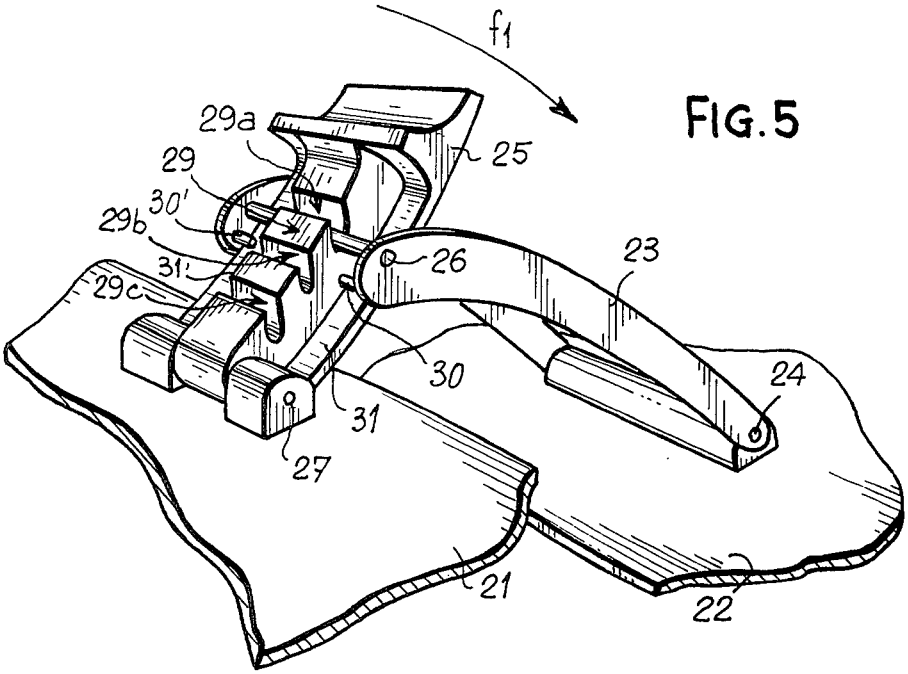
FIG. 5 is a perspective view of a second embodiment in the "walking" position.
Figure 2:
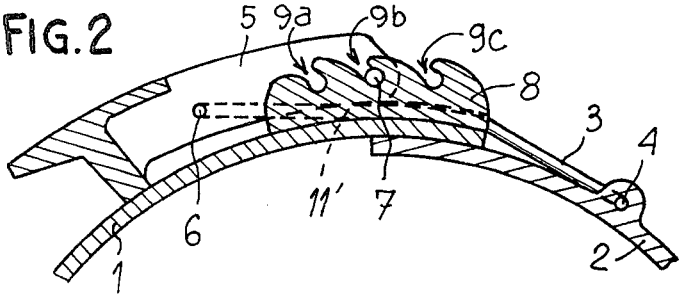
FIGS. 2, 2*a*, 3, 3*a*, 4 and 4*a* are cross-section views of the system shown in FIG. 1, in the closed and intermediate "walking" positions and just prior to the fully-opened position, respectively.
Figure 2A:
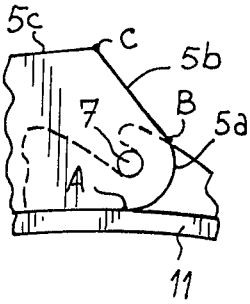

When lever 5 is turned clockwise from its closed position (FIGS. 2 and 2*a*), therefore, rotation takes place freely due to the presence of arc AB. When point B reaches flange 11, the flat surface 5*b* is fully applied against this flange, and creates an obstacle to free continuation of rotary motion (FIGS. 3 and 3*a*). Thus, when lever 5 is unfastened, its opening is limited in amplitude by flat surface 5*b*, which comes into contact with flange 11 or rack 8. As pin 7 of lever 5 is always held in the bottom of a notch, such as 9*b*, of rack 8, a stable intermediate position is obtained in which the boot is loosened (walking or waiting position) (FIGS. 1, 3 and 3*a*).

To release lever 5 from rack 8, lever 5 need merely be swung further in a clockwise direction. Lever 5 then comes into contact with flange 11 of rack 8 by its off-centered apex C (FIGS. 4 and 4*a*), and this has the effect of an effort exerted upward on pin 7, causing this pin to leave notch 9*b*, (see FIG. 4*a*).

It should be noted that the slope of notches 9*a*, 9*b* and 9*c* and/or the relative position of pins 6 and 7 may be designed so that it is unnecessary to bring flaps 1 and 2 of the boot closer together in order to disengage lever 5 from rack 8. In fact, when the lever is opened, pin 7 shifts towards the left, while pin 6 shifts towards the right. It suffices that the movement of pin 7 (toward the left) be smaller than the movement of pin 6 in the opposite direction (i.e., toward the right) to release the tension on loop 3 and cause the boot flaps to spread continuously as the buckle is opened.

It should be noted that, in case the slope of the notches requires the two boot flaps to be brought together, this bringing together will take place automatically by simple rotation of lever 5. This operation may be easily performed with one hand.

It should also be noted that, as lever 5 is closed, pin 7 may be inserted into notches 9*a*, 9*b* or 9*c* without great effort, as it suffices to place pin 7 at the opening of any one of the notches 9*a*, 9*b* or 9*c* and pivot lever 5 in the direction of arrow *f*. Pin 7 then forces one of the notches to open, and lodges itself at the bottom of the notch.

The articulations of traction component 3 on lever 5 and flap 2 are shown as being fixed. However, they may be made adjustable by known means without departing from the field of the invention (screw-and-nut system, rack, etc).

Loop 3 is shown as a flexible material (cable), but it could be a rigid material, as in the second embodiment, described in the following. In the first embodiment, lever 5 is fastened to rack 8 by a male part on the lever and a female part on the rack, but the roles of the male and female parts may be reversed.

In the second embodiment of the invention, shown in FIGS. 5, 6, 7 and 8, the closing system comprises a lever 25 and a traction component 23, hinged on boot-flaps 21 and 22, respectively. The separation takes place between lever 25 and traction component 23. Lever 25 is comprised of an elongated component with a straight, substantially T-shaped section.

Lever 25 is hinged on flap 21 by means of a pin 27. Traction component 23, constituted by a loop of a rigid material, is hinged by one end on flap 22 by means of a pin 24. A pin 26, parallel to pin 24 and placed at the other end of traction component 23, constitutes a catch-pin capable of lodging in any one of notches 29*a*, 29*b* or 29*c* of a rack 29, formed in the web of the T of lever 25. Closing tension varies with the notch selected. Coaxial studs 30 and 30′ are fastened to each branch of loop 23, in the proximity of pin 26, extending inwardly towards one another. These studs 30 and 30′ are designed to come into contact with lateral flanges 31 and 31′, respectively, formed by the wings of the T of lever 25 and bordering central rack 29. The position of studs 30 and 30′ is selected so that, as lever 25 is pivoted clockwise in the direction of arrow *f* from its closed position (FIG. 6) to its stable intermediate "walking or waiting" position (FIGS. 5 and 7), they do not interfere with this pivoting and come into contact with lateral flanges 31 and 31′, respectively, only when the "walking" position has been reached. If opening of lever 25 is continued from this position, studs 30 and 30′ slide along flanges 31 and 31′ towards the free end of lever 25, causing pin 26 to emerge from the notch in which it has been lodged, permitting full opening of the boot.

A third embodiment is shown in FIGS. 9, 10, 11 and 12. With this system, the adjusting rack is not placed neither either on one of the boot flaps (first embodiment) or on the operating lever second embodiment, but instead on the traction component.

As in the foregoing embodiment, a lever 45 is hinged on boot-flap 41 by means of a pin 47. This lever 45 has a transverse pin 46 in its central part, protruding from both sides of the lever and constituting a catch-pin. A traction component 43 made of rigid material is hinged, as in the foregoing embodiments, on the second boot-flap 42 by means of a pin 44. It has the general shape of a U, the extreme lower edges of the two branches of which are provided with a series of notches 49*a*, 49*b* and 49*c* forming racks 49. Pin 46 of lever 45 is inserted in any one of notches 49*a*, 49*b* or 49*c* of the racks on traction component 43. Moreover, lever 45 has two coaxial lateral studs 50 situated in proximity to the pin 46. These studs are situated beneath the lower edges of the two branches of traction component 43.

The position of studs 50 is selected so that, as lever 45 is pivoted clockwise from its closed position (FIG. 10) to its stable intermediate "walking or waiting" position (FIGS. 9 and 11), the studs do not interfere with this pivoting and come into contact with the lower edges of the two branches of traction component 43 only when the "walking" position has been reached. If opening of lever 45 is continued beyond this position, studs 50 slide beneath the lower edges of the branches of traction component 43 and cause pin 46 to emerge from the notch in which it had been lodged.

To the proposed embodiments may be added systems for adjustment of fastening of rack 8 to flap 1, or of traction component 3 to lever 5, or of traction component (3, 23, 43) to flap (2, 22, 42), or of lever (25, 45) to flap (41, 21), by known methods (screw-and-nut systems, rack, etc).

In the three variants proposed, the lever (5, 25, 45) is connected to parts (8, 23, 43,) by means of notches whose opening has a section smaller than that of the pin (7, 26, 46) entering into it (see FIG. 13). A locking action is thus effected which prevents the buckles from opening accidentally in the "walking" position. Pin (7, 26, 46) is forced into the appropriate notch by deformation of the notch or the pin. Preferably, the rack will be made of plastic in order to permit this deformation by a metal pin.

A variant which consists in the provision of a pin (7, 26, 46) of non-circular cross-section, is shown in FIGS. 14, 15 and 16. The figures show a notch 61 with a narrow opening bordered by two parallel edges and a circular bottom having a diameter larger than the width of the opening, and a pin 62 lodging in this notch. The actuating lever has been symbolically represented by a broken line. The system is shown in the position of insertion of the pin (7, 26, 46) in a notch (FIG. 14), in the closed position (FIG. 15) and in the "walking" position (FIG. 16).

Pin 62 has parallel flat surfaces, forming a thin cross-section in this direction to facilitate insertion (FIG. 14). In this case, pin 62 is oriented so that the two flat surfaces are substantially parallel to the edges of the narrow opening of notch 61. In contrast, in the closed or "walking" positions, the pin is held in the bottom of notch 61 by its cylindrical section, whose diameter is the same as that of the bottom, in order to prevent any accidental opening. In this position, the pin presents its larger thickness in the direction parallel to flat surface 62*a*, and thus perpendicularly to the smaller thickness.

Another variant consists in the total absence of a locking system as shown in FIGS. 13, 14, 15 or 16. Nonetheless, this solution presents the disadvantage of permitting accidental opening.

The three embodiments proposed include only a lever (5, 25, 45) and a traction component (3, 23, 43), as this is the simplest system.

The proposed systems are, however, adaptable to buckles having more than two parts. For example, an elastic intermediate part could be inserted between lever (5, 25, 45) and flap (1, 21, 41), or between the traction component (3, 23, 43) and the flap (2, 22, 42).

It suffices for a buckle to have at least one lever (5, 25, 45), one traction component (3, 23, 43), and one part (8) joined to a boot-flap (1, 21, 41), with at least two of these parts acting in cooperation by means of an eccentric system, for it to fall within the field of application of the invention.

It goes without saying that the invention may be employed in various ways. The buckle may be employed for a front-opening or rear-opening boot. It may also be used to tension two ends of straps belonging to a binding system placed between the skier's foot and shell.

What I claim is:

1. A knuckle joint-type closing system for ski boots, for bringing together first and second flaps of the boot, said system comprising: at least one lever hinged to the first boot-flap and a traction component hinged to the second boot flap and to the lever, one of the lever's hinges including a catch-pin, rack means provided with at least one notch for freely engaging said catch-pin, the lever being capable of occupying an initial, closed position flap against the boot, a second, stable intermediate partially-open position, and a third, fully-open position in which the catch-pin is disengaged from the notch, and means for making the catch-pin automatically leave said notch when the opening lever movement is continued beyond the stable intermediate position, thereby separating the two boot-flaps.

2. Closing system pursuant to claim 1, in which the catch-pin has a transverse thickness in one direction which is greater than the width of the opening of the notches.

3. Closing system pursuant to claim 1, in which the catch-pin has a straight, non-circular cross-section having in the transverse direction, two different thicknesses in two perpendicular directions, so that this catch-pin can enter the notch in one position and cannot escape from the notch when the lever is situated in the closed and walking positions.

4. Closing system pursuant to claim 1, wherein said rack means comprises a rack integral with the lever, said means causing the catch-pin of said lever to automatically leave said notch being constituted by a lever component coming into contact with a part of said rack when the lever reaches its stable intermediate position and when the lever exceeds the intermediate position in the direction of the fully-open position.

5. Closing system pursuant to claim 4, wherein said lever component is constituted by an edge of said lever, forming a section successively comprising a first part forming a circular arc, centered on the axis of said catch-pin, then a second part constituted by a flat surface, followed by a third part forming an obtuse angle with the second part, this section being situated opposite a lateral flange of the rack, the radius of the first, circular-arc part being substantially equal to the distance between the center of the catch-pin and the flange when said catch-pin is situtated in the bottom of the notch, this latter distance being smaller than the distance between the apex of the obtuse angle between the second and third parts of the section and the center of the catch-pin.

6. Closing system pursuant to claim 4, in which the lever has two parallel branches in the general shape of a U, the ends of said branches being joined by said catch-pin, said rack means being placed between the branches of the U-shaped lever, the traction component having a rectangular shape and being hinged to a central part of the lever and to the second boot-flap.

7. Closing system pursuant to claim 4, comprising; means adapted selectively to adjust the positions of the hinges of the lever and the traction component relative to said lever, said traction component and said second boot-flap.

8. Closing system pursuant to claim 1, wherein said rack means comprises a rack secured to said lever, said lever being hinged to the first boot-flap, said catch-pin being integral with the traction component and constituting a hinge between the lever and the traction component, the means for causing the catch-pin to automatically leave said notch being constituted by at least one component carried by the traction component and coming into contact with a part of the lever.

9. Closing system pursuant to claim 8, in which the lever is an elongated component with a straight, T-shaped cross-section having a web which constitutes the rack, the traction component being made of a rigid material in the form of a rectangle one side of which is hinged to the second boot-flap, the opposite side carrying said catch-pin, the remaining two sides of the traction component being provided, in the proximity of the catch-pin with coaxial studs facing one another for coming into contact with lateral flanges formed by the wings of the T of the lever and bordering the central rack.

10. Closing system pursuant to claim 9, in which the position of the studs is such that, as the lever is pivoted from its closed position to its stable intermediate position, the studs do not interfere with this pivoting movement, and come into contact with the respective lateral flanges only when the stable intermediate position has been reached, continued movement of the lever beyond said stable intermediate position causing the catch-pin to leave the notch in which it was lodged due to the contact of the studs against the lateral flanges.

11. Closing system pursuant to claim 8, including means for adjustment of at least one of the hinge connections of the lever and the traction component, with the first and second boot-flaps, respectively.

12. Closing system pursuant to claim 1, wherein said rack means comprises a rack on the traction component, said catch-pin being carried by the lever and forming a hinge connection between the lever and the traction component, said means for automatically causing the catch-pin to leave said notch comprising components carried by the lever and coming into contact with the traction component.

13. Closing system pursuant to claim 12, in which said catch-pin comprises a transverse pin housed in the central part of the lever and protruding beyond both sides of said lever; said traction component being made of rigid material, and hinged to the second boot-flap, and having the general shape of a U whose two extreme branches, said rack means being constituted by said branches each having a plurality of said notches in one of which the catch-pin may lodge, said components of the means for causing the catch-pin to leave the notch comprising two coaxial lateral studs on said lever situated in the vicinity of the catch-pin, the position of the said studs being selected so that, as the lever is pivoted from its closed position to its stable intermediate position, the studs do not interfere with this pivoting movement and come into contact with the lower edges of the two branches of the traction component only when this stable intermediate position has been reached, said studs sliding, as the pivoting motion of the lever is continued beyond the stable intermediate position, beneath the lower edges of the branches of the traction component, and causing the pin to leave the notch in which it has been lodged.

14. Closing system pursuant to claim 12, including means to adjust the position of at least one of the hinge connections of the lever and the traction component, on the first and second boot-flaps, respectively.

* * * * *